US005098045A

United States Patent [19]

Pepper

[11] Patent Number: 5,098,045

[45] Date of Patent: Mar. 24, 1992

[54] CONCEALED GUTTER HANGER

[75] Inventor: Kenneth V. Pepper, Plymouth, Wis.

[73] Assignee: Bemis Manufacturing Company, Sheboygan Falls, Wis.

[21] Appl. No.: 421,248

[22] Filed: Oct. 13, 1989

[51] Int. Cl.[5] ..... E04D 13/06

[52] U.S. Cl. ..... 248/48.2; 52/11

[58] Field of Search ..... 248/48.1, 48.2; 52/11, 52/12, 15

[56] References Cited

U.S. PATENT DOCUMENTS

| | | | |
|---|---|---|---|
| 3,189,304 | 6/1965 | Vranyosovics | 248/48.2 |
| 3,295,803 | 1/1967 | Blayden | 248/48.2 |
| 3,296,749 | 1/1967 | Cotter | 248/48.2 |
| 3,436,878 | 4/1969 | Singer | 248/48.2 X |
| 3,752,428 | 8/1973 | Trostle et al. | 248/48.2 |
| 4,241,548 | 12/1980 | Rowe | 248/48.2 X |
| 4,581,857 | 4/1986 | Harbom | 248/48.2 |
| 4,622,785 | 11/1986 | Miller | 52/11 |
| 4,632,342 | 12/1986 | Skinner | 52/11 X |
| 4,776,544 | 10/1988 | Williams | 248/48.1 |
| 4,901,954 | 3/1990 | Fairgrieve et al. | 248/48.2 |

FOREIGN PATENT DOCUMENTS

| | | | |
|---|---|---|---|
| 7415658 | 6/1976 | Netherlands | 248/48.1 |
| 1153837 | 11/1967 | United Kingdom . | |

*Primary Examiner*—David L. Talbott

*Attorney, Agent, or Firm*—Michael, Best & Friedrich

[57] ABSTRACT

Disclosed herein is a rain gutter system comprising a gutter including an outer portion which, when in use, extends vertically and an inner portion which is located in spaced parallel relation to the outer portion and which includes an inner part which, when in use, extends vertically, and a support bracket including a rigid base portion which is adapted to be fixed to a structure and which, when in use, extends vertically, a rigid arm extending outwardly from the base portion and including an outer end engaged with the outer portion of the gutter, and means on the gutter and on the bracket for supporting the inner portion of the gutter from the bracket in response to upward arcuate movement of the gutter about a fulcrum provided by the engagement of the outer portion of the gutter and the arm.

17 Claims, 1 Drawing Sheet

CONCEALED GUTTER HANGER

BACKGROUND OF THE INVENTION

1. Field of the Invention

The invention relates generally to gutter systems and more particularly to systems for supporting a gutter in position adjacent the edge of a roof. Still more particularly, the invention relates to so-called concealed hangers or supporting brackets which support the gutter from above as compared to below and which, as a result, are only briefly or slightly visible by an observer viewing from below.

2. Prior Art

Attention is directed to the U.S. Pat. No. 4,776,544, granted Oct. 11, 1988 which discloses one form of a prior gutter supporting bracket. In use, the bracket is initially assembled to the gutter by sliding the bracket or hanger onto the gutter in the direction of the length thereof. Subsequently, after the supporting bracket and gutter are assembled, the bracket is fixed to the supporting surface. This method of fixing a gutter assembly to a supporting surface requires that the weight of the gutter be supported during fixation of the bracket to the supporting surface and is otherwise undesirable and unwieldly.

Another prior art bracket which is commercially available is like the bracket shown in U.S. Pat. No. 4,776,544 except that the outer vertical support portion 10 disclosed in U.S. Pat. No. 4,776,544 is omitted. In addition, the other prior art bracket has only one outwardly open slot at the outer end of the arm and only one inwardly open slot at the inner end of the arm. Still further in addition, the other prior art bracket includes a downwardly open slot in the bracket adjacent the connection of the support art to the bracket base portion and above the inwardly open slot. In addition, the other prior art support bracket does not include the lateral support portion 11 or the gusset support portion 12 disclosed in U.S. Pat. No. 4,776,544.

In other respects, however, the other prior art support bracket has the same disadvantages as the hanger shown in U.S. Pat. No. 4,776,544, i.e., the bracket is preassembled to a section of gutter by sliding the bracket on the gutter in the direction of the length of the gutter. Consequently, as with the arrangement disclosed in U.S. Pat. No. 4,776,544, the weight of the gutter assembly must be supported when attaching the assembled gutter and hanger to the supporting surface. Such attachment is accordingly, unwieldly and undesirable.

SUMMARY OF THE INVENTION

The invention provides a rain gutter system comprising a gutter including an outer portion including an outer part which, when in use, extends vertically and an inner portion which is located in spaced parallel relation to the outer portion and which includes an inner part which, when in use, extends vertically, and a support bracket including a rigid base portion which is adapted to be fixed to a structure and which, when in use, extends vertically, a rigid arm extending outwardly from the base portion and including an outer end engaged with the outer portion of the gutter, and means on the gutter and on the bracket for supporting the inner portion of the gutter from the bracket in response to upward arcuate movement of the rain gutter about a fulcrum provided by the engagement of the outer portion of the gutter and the arm.

The invention also provides a rain gutter system comprising a gutter including an outer portion including an outer part which, when in use, extends vertically and an outer support which extends inwardly and has an under surface, and an inner portion which is located in spaced parallel relation to the outer portion and which includes an inner part which, when in use, extends vertically, and an inner support which extends outwardly and has an under surface, and a support bracket including a base portion which is adapted to be fixed to a structure and which, when in use, extends vertically, an arm extending outwardly from the base portion and including an outer end engaged with the under surface of the outer support of the outer portion, and a resilient support extending from the arm and movable between a normal supporting position engaged with the under surface of the inner support of the inner portion and a retracted position affording passage therepast of the inner support of the inner portion of the gutter.

The invention also provides a support bracket for a rain gutter system including a gutter having inner and outer horizontally spaced portions, which bracket includes a base portion which is adapted to be fixed to a structure and which, when in use, extends vertically, an arm extending outwardly from the base portion and including an outer end engageable with an outer portion of a gutter, an inner end, and a resilient support extending from the inner end of the arm and movable between a normal supporting position engageable with the inner portion of the gutter and a retracted position affording passage therepast of the inner portion of the gutter.

The invention also provides a method of attaching to a supporting surface a gutter assembly including a gutter having inner and outer horizontally spaced portions and a supporting bracket having a base portion fixable to the supporting surface, and an arm extending outwardly from the base portion and including inner and outer ends which are respectively engageable with the inner and outer portions of the gutter, which method includes the steps of fixing the base portion of the supporting bracket to the supporting structure, engaging the outer portion of the gutter with the outer end of the arm to provide a fulcrum adjacent the outer end of the arm, and rotating the gutter about the fulcrum to supportingly engage the inner portion of the gutter with the inner end of the arm.

Other features and advantages of the invention will become apparent to those skilled in the art upon review of the following detailed description, claims, and drawings.

THE DRAWINGS

Figure 2:
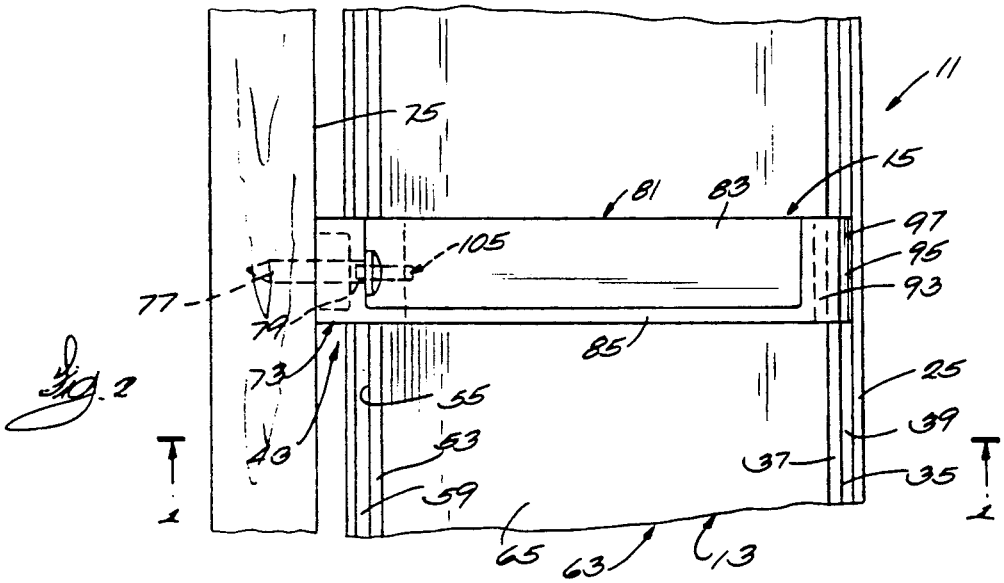
FIG. 2 is a fragmentary top view of the gutter support system in FIG. 1.
Figure 1:
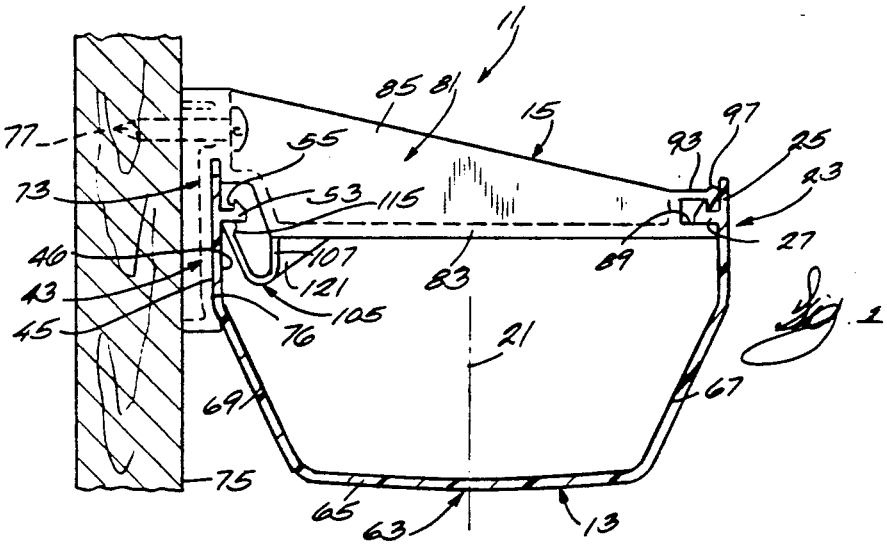
FIG. 1 is a view taken along line 1—1 of FIG. 2 and illustrating, in partial cross section, a gutter support system which embodies various of the features of the invention.
Figure 4:
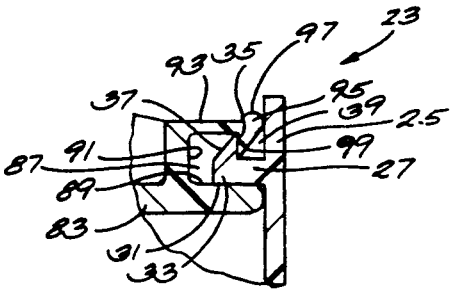

FIG. 4, a fragmentary enlarged view, partially in section, of another portion of the gutter support system shown in FIG. 1.

Before one embodiment of the invention is explained in detail, it is to be understood that the invention is not limited in its application to the details of the construction and the arrangements of components set forth in the following description or illustrated in the drawings. The invention is capable of other embodiments and of being practiced or being carried out in various ways. Also, it is to be understood that the phraseology and terminology used herein is for the purpose of description and should not be regarded as limiting.

GENERAL DESCRIPTION

Shown in the drawings is a gutter assembly or system 11 including a gutter or gutter section 13 and supporting element or bracket or hanger 15.

The gutter 13 is fabricated symmetrically about a vertical center line 21 and, although other materials and processes could be employed, the gutter 13 is preferably extruded in plastic. The gutter 13 includes an outer portion 23 including an outer part 25 which, in use, extends vertically, and an outer support or rib or part 27 which extends inwardly from the vertically extending outer part 27 and which includes an under surface 31. At its inner end, the outer support 27 includes an upwardly extending half gable or barb 33 including a vertical wall 35 and a sloping roof wall 37. The vertical wall 35 and the upper end of the outer part 25 define an upwardly open slot 39.

The gutter 13 also includes an inner portion 43 including an inner part 45 which, in use, extends vertically, and which includes a surface 46 facing outwardly i.e., toward the outer portion 23. The inner portion 43 also includes an inner support or rib or part 45 which extends outwardly from the vertically extending inner part 47 and which includes an under surface 51. At its outer end, the inner support 47 includes an upwardly extending half gable or barb 53 including a vertical wall 55 and a sloping roof wall 57. The vertical wall 55 and the upper end of the inner part 45 define an upwardly opening slot 59.

Connecting the outer and inner portions 23 and 43 of the gutter 13 is a trough portion 63 including a bottom wall 65 and opposed inclined walls 67 and 69.

The bracket 15 is intended to support the gutter 13 along the edge of a roof and, in general, without disclosing its presence, particularly when viewed from the ground. Thus, in use, and except for a small part at the bottom, the bracket is generally hidden from view from an observe looking upwardly. More particularly, while the bracket 15 can be fabricated of various materials and by various processes, the bracket 15 is preferably molded in one piece of plastic material and, except as otherwise indicated herein, is rigid. The bracket 15 includes a rigid base portion or baseplate 73 which, in use, extends vertically, which is adapted to be attached to a supporting vertical surface or fascia board 75 by one or more screws 77 extending through one or more suitable apertures 79 in the base portion 73, and which includes a vertically extending outer surface 76.

The bracket 15 also includes a rigid arm 81 which rigidly extends integrally outwardly from the top of the base portion 73 and which, preferably, is generally L-shape in vertical cross-section including a horizontally extending portion 83 and a vertically extending portion 85 extending upwardly from the horizontal portion 83. At its outer end, the arm 81 is configured to include an outwardly open slot 87 defined by the upper surface 89 of the outer end of the horizontally extending portion 83, by a vertical wall 91 extending upwardly from inwardly of the outer end of the horizontal portion 83, and by a projection 93 extending horizontally from the upper end of the vertical wall 91 in spaced relation above the upper surface 89 and having, at the outer end thereof, an enlarged head or barb 95 with a rounded upper part 97 and with a downwardly pointed lower part 99 terminating in spaced relation from the upper surface 89 by an amount approximately equal to the vertical thickness of the outer support 27 of the outer portion of the gutter 13. Preferably the projection 93 is flexibly connected to the outer end of the arm 81 and the head 95 is manually located in the upwardly open slot 39 after insertion of the outer surface 27 into the outwardly open slot 87.

In assembled relation, as will be further pointed outer hereinafter, the outer support 27 extends into the slot 87, and is supported by the upper surface 89 to support the outer portion 23 of the gutter 13 from the bracket 15. In addition, the enlarged head 95 extends into the slot 39 to prevent horizontal movement between the gutter 13 and the bracket 15.

At its inner end, and adjacent the lower part thereof, the arm 81 is notched or recessed as illustrated to provide space 101 between the outer surface 76 of the base portion 73 and the lower inner end of the arm 81 and thereby to facilitate engagement of the inner portion 43 of gutter 13 with the bracket 15 by arcuate upward movement of the gutter about a fulcrum at the outer end of the support arm 81. In this regard, means are also provided on the bracket 15 and on the gutter 13 for supporting the inner portion 43 of the gutter 13 from the bracket 15 in response to upward arcuate movement of the gutter 13 about a fulcrum provided by engagement of the outer portion 23 of the gutter 13 and the outer end of the arm 81 of the bracket 15. While various other arrangements can be employed, in the disclosed construction, such means includes the provision on the bracket 15 of a resilient support or finger 105 extending from the lower inner end of the arm 81 and from a location spaced outwardly from the outer vertical surface 76 of the base portion 73 of the bracket 15.

The support finger 105 includes a downwardly extending rigid part 107 having a lower end, and a resilient flexible part 109 including a curved portion 111 extending from the lower end of the rigid part 107 and having an outer end, and an outer part 113 which, in use, extends upwardly and inwardly toward the juncture of the inner surface of the inner part 45 of the inner portion 43 of the gutter 13 and the under surface 51 of the inner support 47 of the inner portion 43 of the gutter 13. Preferably, at its outer end, the outer part 113 includes an enlarged head 115 having a top surface 117 which extends, when in extending position, from the just mentioned junction outwardly along the under surface 51 of the inner support 47 of the gutter 13.

Preferably, the hanger or supporting bracket 15 also includes a vertically extending gusset 121 extending between the horizontally extending portion 83 of the support arm 81 and the rigid part 107 of the supporting finger 105, whereby to assist in rigidifying the rigid part 107 of the supporting finger 105.

Figure 3:
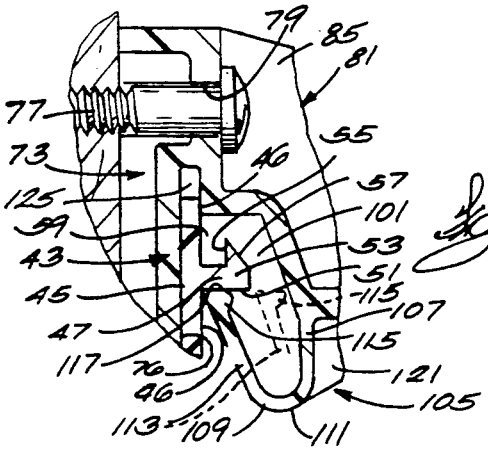
FIG. 3 is a fragmentary enlarged view, partially in section, of a portion of the gutter support system shown in FIG. 1.

In order to further facilitate assembly of the gutter 13 with the support bracket in response to arcuate movement about a fulcrum at the outer end of the supporting arm 81, the bracket 15 includes a downwardly opening slot 125 which is located adjacent the juncture of the base portion 73 and the support arm 81 and which is adapted to accommodate upward over-travel of the gutter 13 beyond a horizontal position, which upward over-travel serves to enable passage of the inner support 47 upwardly beyond the head 115 of the support finger 105 when the upper end of the support finger 105 is flexed outwardly to a retracted position located adjacent the support arm 81 and shown in dotted outline in FIG. 3.

Means are provided on the bracket 15 on the gutter 13 for holding the gutter 13 against horizontal movement relative to the bracket 15. While other arrangements can be employed, in the construction illustrated in the drawings, the gutter holding means comprises means on the outer end of the support arm 81 and on the outer portion 23 of the gutter 13 for holding the gutter 13 against horizontal movement relative to the bracket 15. While other specific constructions can be employed, in the disclosed construction, such means includes the slot 39 formed in the gutter 13 and the head 95 extending from the projection 93 on the support arm 81 and into the slot 39 in such manner as to prevent relative horizontal movement between the gutter 13 and the bracket 15.

The means for holding the gutter 13 against horizontal movement relative to the bracket 15 also include means on the inner portion 43 of the gutter 13 and on the bracket 15 for holding the gutter 13 against horizontal movement relative to the bracket 15. While other specific constructions can be employed, in the disclosed construction, such means includes the receipt of the upper end of the inner part 45 of the inner portion 43 of the gutter 13 in the slot 125 formed in the bracket 15 in such manner as to prevent relative horizontal movement between the gutter 13 and the bracket 15.

In assembly of the gutter system 11, the bracket 15 is first suitably attached to the supporting surface 75 of the structure by screws 77 or otherwise. Thereafter, the outer portion 23 support of the gutter 13 is inserted into the outwardly open slot 87 and past the flexibly supported head 95. Thereafter the flexibly supported head 95 is inserted into the upwardly opening slot 39 in the gutter 13. Still further thereafter, the inner portion 43 of the gutter 13 is then rotated (in the clockwise direction as shown in the drawings) about the fulcrum provided by engagement of the outer portion 23 of the gutter 13 and the support arm 81 until the inner support 45 engages the outer end of the supporting finger 105 when the supporting finger 105 is in the normal extending or supporting position. As the gutter 13 is further rotated in the clockwise direction, as shown int he drawings, such engagement causes the resiliently flexible supporting finger 105 to move or flex sufficiently to the right in the recess 101 to the retracted position permitting passage thereby of the inner support 47 and location of the upper end of the inner part 45 in the slot 125. Upon passage of the inner support 47 past the outer end of the outer part 113 of the supporting finger 105, the finger 105 resiliently moves to its normal extending or supporting position in spaced relation from the lower inner end or corner of the supporting arm 81 and into engagement with the inner surface of the inner support 45 of the inner portion 43 of the gutter 13. When the gutter 13 is subsequently lowered to a horizontal position, the upper or top surface 117 of the enlarged head 115 of the resilient supporting finger 105 will engage the under surface 51 of the inner support 47 of the inner portion 43 of the gutter 13 to support the gutter 13 along its inner margin.

If disassembly of the gutter 13 from the supporting bracket 15 is desired, the inner portion 43 of the gutter 13 can be raised slightly and the outer part 113 of the supporting finger 105 manipulated to displace the outer part 113 to the retracted position adjacent the lower inner end or corner of the support arm 81, thereby to facilitate downward passage of the inner support 47 past the supporting finger 105 and to subsequently enable disassembly of the outer portion 23 of the gutter 13 from the outer end of the support arm 81 of the bracket 15. Accordingly, the disclosed construction provides an arrangement whereby the gutter 13 can be rotated into supporting engagement with the bracket 15 which has been previously fixed to the supporting surface 75. In addition, the bracket 15 is, for practical purposes, hardly noticeable when the gutter assembly is viewed from underneath. Only a small portion of the base portion 73 of the bracket 15 is viewable from underneath. In addition, the invention allows for free longitudinal movement of the gutter 13 relative to the bracket 15 in response to thermal expansion and contraction.

Various of the features of the invention are set forth in the following claims.

I claim:

1. A rain gutter system comprising a gutter including an outer portion including an outer part which, when in use, extends vertically and an outer support which extends inwardly and has an under surface, and an inner portion which is located in spaced parallel relation to said outer portion and which includes an inner part which, when in use, extends vertically and an inner support which extends outwardly and has an under surface, said inner part of said inner portion having an outwardly facing surface, and a support bracket including a base portion which is adapted to be fixed to a structure and which, when in use, extends vertically, an arm extending outwardly from said base portion and including an outer end including a first generally horizontal surface, and a second generally horizontal surface in opposed spaced relation to said first horizontal surface, said first and second horizontal surfaces terminating in a substantially vertical plane and defining therebetween an outwardly opening slot engaged with said under surface of said outer support of said outer portion, and a resilient support extending from said arm and movable between a normal supporting position engaged with said under surface of said inner support of said inner portion and a retracted position affording passage therepast of said inner support of said inner portion of said gutter, said resilient support comprising a U-shaped finger having a rigid portion extending downwardly from said arm from a location in horizontally spaced relation from said base portion and including a lower end, and a flexibly resilient portion including a curved part extending from said lower end of said rigid portion and having an outer end, and an end part extending upwardly from said outer end of said curved part and toward said outwardly facing surface of said inner part and toward said under surface of said inner support.

2. A rain gutter system in accordance with claim 1 wherein said bracket and said gutter include means holding said gutter against horizontal movement relative to said bracket.

3. A rain gutter system in accordance with claim 2 wherein said gutter holding means comprises means on said arm and said outer portion for holding said gutter against horizontal movement relative to said bracket.

4. A rain gutter system in accordance with claim 3 wherein said gutter further includes a wall extending upwardly from said outer support of said outer portion and forming with said outer part of said outer portion an upwardly open slot, wherein said means on said gutter comprises said slot, and wherein said means on said arm comprises a part extending into said slot.

5. A system in accordance with claim 2 wherein said gutter holding means includes means on said inner portion of said gutter and on said bracket for holding said gutter against horizontal movement relative to said bracket.

6. A system in accordance with claim 5 wherein said inner part of said inner portion of said gutter includes an upper end, wherein said means on said bracket includes a downwardly open slot in said bracket, and wherein said means on said inner portion of said gutter comprises said upper end which is received in said slot.

7. A system in accordance with claim 1 and further including a rigid gusset extending between said rigid portion of said finger and said arm.

8. A rain gutter system as set forth in claim 1 and further comprising means including said outer portion of said gutter and said outer end of said arm for affording pivotal movement of said gutter relative to said bracket, wherein said resilient portion of said finger supports said inner portion of said gutter in response to said pivotal movement of said gutter relative to said bracket.

9. A rain gutter system as set forth in claim 8 wherein said gutter has a centerline, and wherein said inner and outer portions of said gutter are formed symmetrically about said centerline.

10. A rain gutter system comprising a gutter having inner and outer horizontally spaced portions which, when in use, extend vertically, said inner portion including an outwardly extending support and a wall extending upwardly beyond said outwardly extending support, and said outer portion including an inwardly extending support and a wall extending upwardly beyond said inwardly extending support, and a support bracket including a base portion which is adapted to be fixed to a structure and which, when in use, extends vertically, an arm extending outwardly from said base portion and including an outer end engagable with said outer portion of said gutter, an inner end, and a resilient support extending from said inner end of said arm and movable between a normal supporting position engagable with said inner portion of said gutter and a retracted position affording passage therepast of said inner portion of said gutter, said resilient support including a U-shaped finger having a rigid portion extending downwardly from said inner end of said arm from a location in horizontally spaced relation from said base portion and including a lower end, and a flexibly resilient portion including a curved part extending from said lower end of said rigid portion and having an outer end, and an end part extending upwardly from said outer end of said curved part for supporting engagement with said inner portion of said gutter.

11. A gutter system as set forth in claim 10 wherein said gutter includes a center line and wherein said gutter is formed symmetrically about said center line.

12. A system in accordance with claim 10 and further including a rigid gusset extending between said rigid portion of said finger and said arm.

13. A rain gutter system as set forth in claim 10 wherein said gutter has a centerline, and wherein said inner and outer portions of said gutter are formed symmetrically about said centerline.

14. A rain gutter system comprising a gutter having inner and outer horizontally spaced portions which, when in use, extend vertically, and a support bracket including a base portion which is adapted to be fixed to a structure and which, when in use, extends vertically, an arm extending outwardly from said base portion and including an outer end engageable with said outer portion of said gutter, and an inner end, and a resilient support extending from said inner end of said arm and including a U-shaped finger having a rigid portion extending downwardly from said inner end of said arm from a location in horizontally spaced relation from said base portion and including a lower end, and a flexibly resilient portion extending upwardly from said lower end of said rigid portion and being movable between a normal supporting position in which said resilient portion supports said inner portion of said gutter and a retracted position affording passage therepast of said inner portion of said gutter.

15. A rain gutter system as set forth in claim 14 and further comprising means including said outer portion of said gutter and said outer end of said arm for affording pivotal movement of said gutter relative to said bracket, wherein said resilient portion of said finger supports said inner portion of said gutter in response to said pivotal movement of said gutter relative to said bracket.

16. A rain gutter system as set forth in claim 15 wherein said gutter has a centerline, and wherein said inner and outer portions of said gutter are formed symmetrically about said centerline.

17. A support bracket for a rain gutter having inner and outer horizontally spaced portions which, when in use, extend vertically, said bracket comprising a base portion which is adapted to be fixed to a structure and which, when in use, extends vertically, an arm extending outwardly from said base portion and including an outer end engageable with the outer portion of the gutter, and an inner end, and a resilient support extending from said inner end of said arm and including a U-shaped finger having a rigid portion extending downwardly from said inner end of said arm from a location in horizontally spaced relation from said base portion and including a lower end, and a flexibly resilient portion extending upwardly from said lower end of said rigid portion and being movable between a normal supporting position in which said resilient portion is engageable with the inner portion of the gutter to support the gutter and a retracted position affording passage therepast of the inner portion of the gutter.

* * * * *